US011857047B2

(12) United States Patent
Frank

(10) Patent No.: US 11,857,047 B2
(45) Date of Patent: Jan. 2, 2024

(54) LUGGAGE COMPRISING A HOLDING SYSTEM WITH STRAPS

(71) Applicant: PA. COTTE SA, Pully (CH)

(72) Inventor: Yannik Frank, Nantes (FR)

(73) Assignee: PA.COTTE SA, Pully (CH)

( * ) Notice: Subject to any disclaimer, the term of this patent is extended or adjusted under 35 U.S.C. 154(b) by 179 days.

(21) Appl. No.: 17/422,289

(22) PCT Filed: Jan. 14, 2020

(86) PCT No.: PCT/EP2020/050810

§ 371 (c)(1),
(2) Date: Jul. 12, 2021

(87) PCT Pub. No.: WO2020/148278

PCT Pub. Date: Jul. 23, 2020

(65) Prior Publication Data

US 2022/0087388 A1 Mar. 24, 2022

(30) Foreign Application Priority Data

Jan. 15, 2019 (FR) ..... 1900336

(51) Int. Cl.

| | |
|---|---|
| ***A45C 13/02*** | (2006.01) |
| ***A45C 3/02*** | (2006.01) |
| ***A45C 5/03*** | (2006.01) |

(52) U.S. Cl.

CPC ..... *A45C 13/02* (2013.01); *A45C 3/02* (2013.01); *A45C 5/03* (2013.01); *A45C 2013/026* (2013.01)

(58) Field of Classification Search

CPC .. A45C 13/02; A45C 3/02; A45C 5/03; A45C 2013/026

See application file for complete search history.

(56) References Cited

U.S. PATENT DOCUMENTS 749,959 A * 1/1904 Curtiss ..... A45C 13/02 190/36
1,429,608 A * 9/1922 May ..... A45C 7/0095 206/292

(Continued)

FOREIGN PATENT DOCUMENTS

CN 103391861 11/2013
DE 1020800 12/1957

(Continued)

OTHER PUBLICATIONS

English translation of the Written Opinion issued by the International Searching Authority, dated Jun. 16, 2021, for International Patent Application No. PCT/EP2020/050810; 5 pages.

(Continued)

*Primary Examiner* — Tri M Mai
(74) *Attorney, Agent, or Firm* — Faegre Drinker Biddle & Reath LLP

(57) ABSTRACT

A piece of luggage includes a holding system including at least one strap intended to hold an object in a storage position inside the piece of luggage by pressing the object against a wall of the piece of luggage called the support wall. The holding system includes: at least one rail carried by the support wall, the strap extending to cover the rail in the absence of stresses; and at least one tightening member slidably mounted on the rail at least partially covering the strap.

12 Claims, 6 Drawing Sheets

(56) References Cited

U.S. PATENT DOCUMENTS

| | | | | |
|---|---|---|---|---|
| 1,496,498 | A * | 6/1924 | Tantlinger | A45C 13/02 190/36 |
| 2,698,689 | A * | 1/1955 | Novack | G09F 5/02 15/267 |
| 6,739,754 | B2 * | 5/2004 | Moor | A45F 5/12 190/102 |
| 9,751,448 | B2 | 9/2017 | Decorme | |
| 9,796,523 | B2 * | 10/2017 | Benoit | B65D 85/187 |
| 9,936,781 | B2 * | 4/2018 | Lindholm | A45C 11/00 |
| 2009/0039122 | A1 * | 2/2009 | Antonioni | B60R 7/005 224/250 |
| 2015/0296948 | A1 | 10/2015 | Kung | |
| 2016/0007703 | A1 | 1/2016 | Sheikh | |
| 2017/0196332 | A1 * | 7/2017 | Tong | A45C 13/03 |
| 2018/0263344 | A1 | 9/2018 | Seminara | |

FOREIGN PATENT DOCUMENTS

| | | |
|---|---|---|
| EP | 1097846 | 5/2001 |
| EP | 2436561 | 4/2012 |
| EP | 2436562 | 4/2012 |
| JP | 2000184909 | 7/2000 |
| WO | 2008/034603 | 3/2008 |

OTHER PUBLICATIONS

International Search Report and Written Opinion issued by the International Searching Authority, dated Feb. 7, 2020, for International Patent Application No. PCT/EP2020/050810; 12 pages.

* cited by examiner

LUGGAGE COMPRISING A HOLDING SYSTEM WITH STRAPS

CROSS-REFERENCE TO RELATED APPLICATIONS

The present application is a national stage entry of International (PCT) Patent Application Number PCT/EP2020/050810, filed Jan. 14, 2020, which claims priority to French Patent Application No. 1900336, filed Jan. 15, 2019, the subject matter of each is expressly incorporated herein by reference.

The field of the invention is that of the design and manufacture of pieces of luggage. More specifically, the field of the invention is that of accessories for briefcase.

The invention applies to any luggage piece type, such as suitcases, and in particular to cases of the "briefcase" type.

Cases of the "briefcase" type allow documents or other objects to be transported easily and safely.

In the field of the invention, holding systems are known which allow to hold objects in a storage position inside a piece of luggage.

The holding systems can be of the "strap" type, the straps being designed to hold one or more objects in a storage position inside a piece of luggage by pressing the object against a wall of the piece of luggage.

For example, it is common for suitcases to have straps that extend from a bottom of the suitcase. The straps extend in particular from two sides of the bottom of the case, the sides being opposite to each other, these straps being able to join and couple with each other in a central position in the suitcase.

It is therefore up to a user to put the straps on hold on each side of the suitcase, to position their belongings on the bottom of the suitcase, then to tighten each of the straps and couple them to each other in such a way that they exert a tension to keep the belongings pressed on the bottom of the suitcase.

From the prior art, various types of improvement of these strap holding systems are known.

For example, the patent document published under the n° DE1020800 describes a solution proposed to improve the members allowing to lock two straps to each other and to hold an object pressed inside a travel suitcase.

According to this solution, the locking member is designed to prevent the straps from being located on the bottom when the user is filling the suitcase. In this way, the straps are not covered by the contents of the suitcase and they can then be easily grasped to be coupled and locked to each other and to exert their holding.

The strap holding system described in the patent document published under the n° US2017/0196332 is also known.

According to this document, members for holding a strap in a predetermined position allow easy filling of the piece of luggage, without the strap being covered by objects added inside the piece of luggage.

These holding members are in the shape of buckles fixed to a wall of the piece of luggage, these holding members being able to temporarily accommodate the strap so as to hold it in the predetermined position.

The straps described in this document do not allow a perfect hold of a single object because these straps do not fully adapt to the shape of the object to be held inside the pieces of luggage. For example, in the case where several objects must be held, the strap then only performs an overall hold by pressing the objects against the wall of the piece of luggage.

Also, it is known that in order to adjust straps, the latter may be elastic and/or have means for adjusting the tension of the buckle or scratch strap.

However, although it allows the tension to be adjusted, and as with the strap holding systems described above, the tightening system does not allow the hold achieved on objects which may have variable shapes and sizes to be optimized.

In addition, achieving the holding may not be easy for a user. The user may indeed have to repeat it several times to achieve the placement of one or more objects and to obtain the holding in position using the strap holding system.

Finally, for example in the context of pieces of luggage of the "briefcase" type, it may be desirable for the strap holding system to be discreet, easy to use and robust.

Indeed, if the user were not to use the straps, it would then appear appreciable for this user that the strap holding mechanism is not penalizing in terms of the visual of his piece of luggage, in terms of the size of the holding system inside his piece of luggage and relative to the weight of this holding system.

The purpose of the invention is in particular to overcome the drawbacks of the prior art.

More specifically, the purpose of the invention is to provide a piece of luggage provided with a strap holding system allowing to hold objects that may have variable dimensions, or even to effectively hold together these objects of variable shape and dimensions.

The purpose of the invention is also to provide such a piece of luggage in which the holding system is particularly easy to use.

Another purpose of the invention is to provide such a piece of luggage in which the holding system is as discreet as possible when it is not used to hold an object.

These purposes, as well as others which will appear subsequently, are achieved thanks to the invention which relates to a piece of luggage comprising a holding system comprising at least one strap intended to hold an object in a storage position inside the piece of luggage by pressing the object against a wall of the piece of luggage called the support wall, characterized in that the holding system comprises:

- at least one rail carried by the support wall, the strap extending to cover the rail in the absence of stresses,
- at least one tightening member slidably mounted on the rail at least partially covering the strap;

and in that the tightening member is movable between:

- an unlocked state in which the tightening member slides freely along the rail;
- a locked state in which the tightening member is immobilized on the rail.

Thanks to the piece of luggage according to the invention, a user can have a holding system with strap(s) that is easy to use and can effectively hold objects of different sizes, such as for example pens, a smartphone, a tablet or else books inside the piece of luggage.

Also, the holding system is discreet when not in use to hold an object. Indeed, thanks to the strap which extends to cover the rail in the absence of stress, the latter is not loose inside the piece of luggage and does not interfere with or produce a significant bulk of the space located inside the piece of luggage.

To use the piece of luggage and the holding system of a piece of luggage, the user must grasp the strap and pull it away from the support wall. In this way, he creates a space between the strap and the bottom in which he can insert his object. All the user then has to do is release the strap and slide the tightening member, of course previously placed in an unlocked state, along the rail then, once this tightening member has reached a position where it provides support which is efficient and adapted to the object through the strap, then it must be placed in its locked state. In this locked state, the strap then takes on an object-specific shape and allows it to be optimally held inside the piece of luggage.

In other words, the tightening element allows to hold a portion of the strap between the wall and another portion of the strap against the object by reducing, or even eliminating any clearance between the strap and the object.

Such a system with a sliding tightening member proves to be simple and easy to use.

According to a preferred solution of the invention, the tightening member comprises a bar covering the strap, and a base carrying the bar and sliding on the rail, and:

in the unlocked state of the tightening member, the bar is in a low position close to the rail;

in the locked state of the tightening member, the bar is in a high position remote from the rail relative to the low position, the strap being capable of pulling the bar from its low position to its high position.

According to this design, to slide the tightening member, a user simply needs to ensure that the bar is in its low position. Thus, to ensure that the bar is in its low position, the user only needs to press on the bar to hold it in its low position and then slide the tightening member by pushing or pulling the bar along the rail. Such a system therefore proves to be particularly easy to use.

Additionally, thanks to this design, adjusting the position of the tightening member to hold an object drives the tightening member to a position where the strap continuously pulls the bar from its low position to its high position.

Indeed, because the strap extends to cover the rail in the absence of stress, then the positioning of an object between the support wall and the strap thereby moves the strap away from the support wall. Thus, the strap, while holding an object, is moved away from the support wall and tends to push the bar back from its low position to its high position and to hold the bar in the high position.

Consequently, the sliding of the tightening member in the direction of an object in order to be able to adapt the strap and increase the pressure exerted by the strap on the object takes place at the same time as a traction of the strap is exerted on the object. This results in holding the bar in its high position and, consequently, the tightening member in its locked state.

This design thus offers an adjustment of the strap which is simple and easy to implement to hold an object inside the piece of luggage.

According to a first advantageous embodiment of the invention, the base extends longitudinally parallel to the rail and has along its length:

a first end portion having two surfaces opposite to each other, one called "ventral surface" being in contact with a surface oriented towards the top of the rail, and the other called "dorsal surface" being in contact with a surface oriented towards the bottom of the rail, each of the dorsal surface and of the ventral surface having an edge intended to be placed in the blocking position on the rail in the high position of the bar;

a second end portion, opposite the first end portion and carrying the bar, the second end portion being at least partially movable in height relative to the rail, and the first end portion forms a sliding connection with the rail.

This embodiment allows to have a mechanism which does not produce noise, which is robust, and which allows to provide a large number of positions for the tightening member.

In addition, the holding system can then be formed from a reduced number of parts, and thus have a low weight, which is particularly advantageous in the context of a piece of hand luggage to be carried by its user.

According to this embodiment, the switching of the tightening member from its unlocked state to its locked state occurs by bracing the base. Indeed, the design of this embodiment produces a leverage effect when the bar switches from its low position to its high position. When the bar switches to its high position, the base is then inclined or braced relative to the rail. The first end portion opposite the second end portion (which carries the bar) then moves away from the sliding axis formed by the rail, and the ventral and dorsal surfaces then no longer form a sliding connection which is perfectly free to slide due to the fact that the edges are placed in the blocking position on the rail.

More specifically, the lifting of the second end portion produced by switching the bar from its low position to its high position applies the edges against the rail in their blocking position.

In their blocked position, the edges exert pressure against the rail and produce a sort of a spiking effect (without the edges penetrating into the rail).

This design, as mentioned previously, does not cause noise (compared to a rack for example) due to the fact that there are no real notches to produce the blocking effect and also allows, for the same reasons, not to have a predefined position along the rail for locking the tightening member.

In addition, this mechanism proves to be particularly robust due to the simplicity of its design, the base being able to be made in one piece.

In this case, preferably, the edges are longitudinally offset from each other along the base, the edge belonging to the dorsal surface being located between the second end portion and the edge belonging to the ventral surface.

The longitudinal offset of the edges allows simultaneous blocking of the two edges on the surface oriented towards the top of the rail and on the surface oriented towards the bottom of the rail when the bar switches from its low position to its high position.

Locking is then optimized.

Advantageously, the base has a central spacing portion located between the first end portion and the second end portion.

This central spacing portion allows to increase the leverage effect that occurs when the bar switches from its low position to its high position and thus the ability of the tightening member to remain in its locked state.

According to an advantageous variant embodiment, the base is split into two side portions symmetrical to each other relative to a longitudinal plane passing through a central axis of the rail and perpendicular to the support wall, the two side portions being located on either side of the bar, and the rail has a support strip for the strap which is housed between the two side portions of the base.

Thanks to this variant, the tightening member can have a reduced height. Indeed, in this way the elements necessary for the ability of the tightening member to slide on the rail are offset from below the bar to the side of the bar. The strap, when it is positioned to cover the rail in the absence of stress, may be directly covering the support strip of the rail without the elements necessary for sliding being interposed between this support strip and the strap.

According to a second preferred embodiment of the invention, the tightening member has at least one friction surface, and:

- in the high position of the bar, the friction surface is remote from the rail;
- in the low position of the bar, the friction surface is applied against the rail.

According to this design, the tightening member has braking means thanks to this or these friction surfaces.

This design provides effective hold of the tightening member in its locked state.

According to a preferred feature of the piece of luggage according to the invention, the base comprises:

- a carriage sliding on the rail;
- means for transmitting the movement of the bar, comprising at least one lever mounted movably in rotation on the carriage, the lever having:

- the friction surface(s);
- a means for connection to the bar, the bar being movable relative to the carriage so as to move the friction surface(s).

With this design, switching the bar from its low position to its high position causes the rotation of the lever(s) and the application of the friction surface(s) against the rail. The carriage thus forms a support on which the lever(s) and the bar are movably mounted.

This lever mechanism allows to obtain a reduction in the stroke performed by the bar to rotate the lever(s) and the application of the friction surface against the rail.

Preferably, the base has at least one wheel essentially underlying the bar, the wheel(s) being able to roll on the rail during sliding of the tightening member.

In this way, when the user wishes to move the tightening member, he can press on the bar without fear that forces exerted on the bar will slow down the movement of the tightening member along the rail. Indeed, in this case, the wheels contact the rail when the user presses on the bar so as to place it in its low position.

According to an advantageous variant embodiment of the invention:

- one of the base or the rail has two grooves symmetrical to each other relative to a longitudinal plane passing through a central axis of the rail and perpendicular to the support wall;
- the other of the base or the rail has two tabs each complementary to one of the grooves, the tabs forming slide connections with the grooves.

According to the design of this variant embodiment, the base and the rail cooperate in an optimized manner and, more particularly, the base is then nested on the rail in such a way that it cannot be easily torn from the rail by the strap.

Indeed, the base is then held on the rail by two slide connections located on either side of the central axis of the rail.

Advantageously, for a strap, the holding system comprises at least two tightening members.

Thanks to this design, an object can be held along the rail at different possible positions by then moving the two tightening members to suitable locations. This design also allows to hold at least two objects. For example, a first object can be held between the end of the support wall and a first tightening member, a second object can then be held between the first tightening member and the second tightening member.

According to an advantageous feature of the invention, the support wall has a recess housing the rail, the strap flush with the surface of the support wall directly adjacent to the recess in the absence of stresses.

Thanks to this design, the holding system is as discreet as possible when not in use.

In addition, this design eliminates the need for a strap protruding from the support wall directly adjacent to the recess housing the rail.

Other features and advantages of the invention will emerge more clearly upon reading the following description of various preferred embodiments of the invention, given by way of illustrative and non-limiting examples, and the appended drawings, among which:

FIG. 1 is a perspective view of a piece of luggage according to the invention;

FIG. 2*a* schematically illustrates, in a longitudinal section and in cooperation with other FIGS. 2, the operation of the holding system of a piece of luggage according to the invention;

FIG. 2*b* schematically illustrates, in a longitudinal section and in cooperation with other FIGS. 2, the operation of the holding system of a piece of luggage according to the invention;

FIG. 2*c* schematically illustrates, in a longitudinal section and in cooperation with other FIGS. 2, the operation of the holding system of a piece of luggage according to the invention;

FIG. 2*d* schematically illustrates, in a longitudinal section and in cooperation with other FIGS. 2, the operation of the holding system of a piece of luggage according to the invention;

FIG. 2*e* schematically illustrates, in a longitudinal section and in cooperation with other FIGS. 2, the operation of the holding system of a piece of luggage according to the invention;

FIG. 2*f* schematically illustrates, in a longitudinal section and in cooperation with other FIGS. 2, the operation of the holding system of a piece of luggage according to the invention;

FIG. 2*g* schematically illustrates, in a longitudinal section and in cooperation with other FIGS. 2, the operation of the holding system of a piece of luggage according to the invention;

Figure 4:
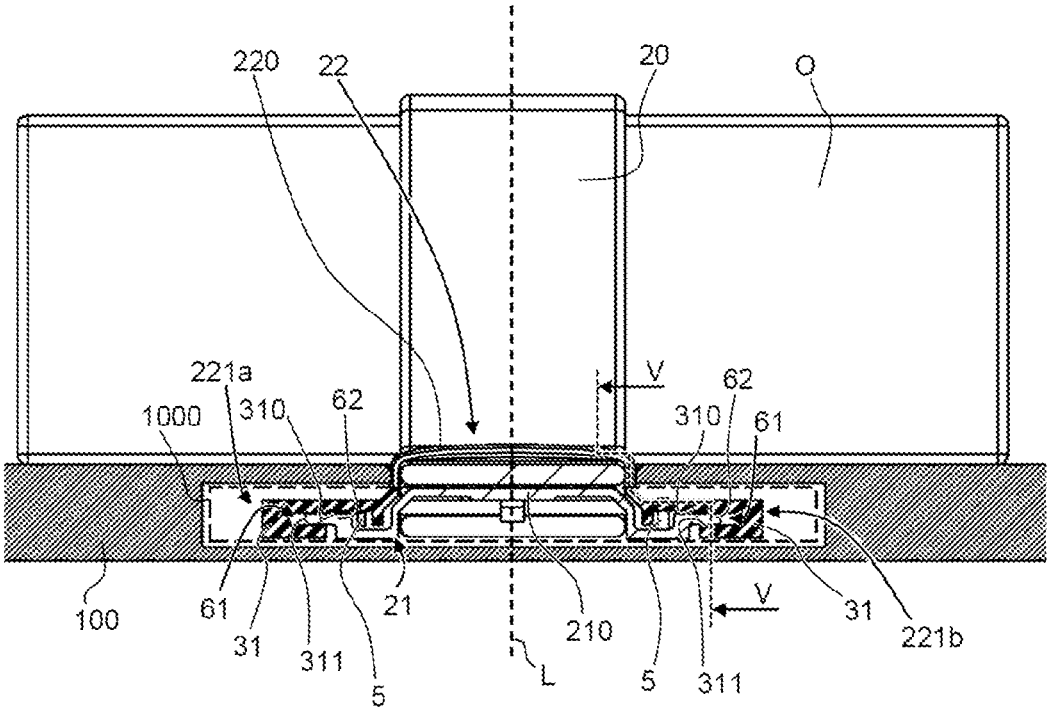
FIG. 4 is a cross-sectional view of the first embodiment of the invention.
Figure 6:
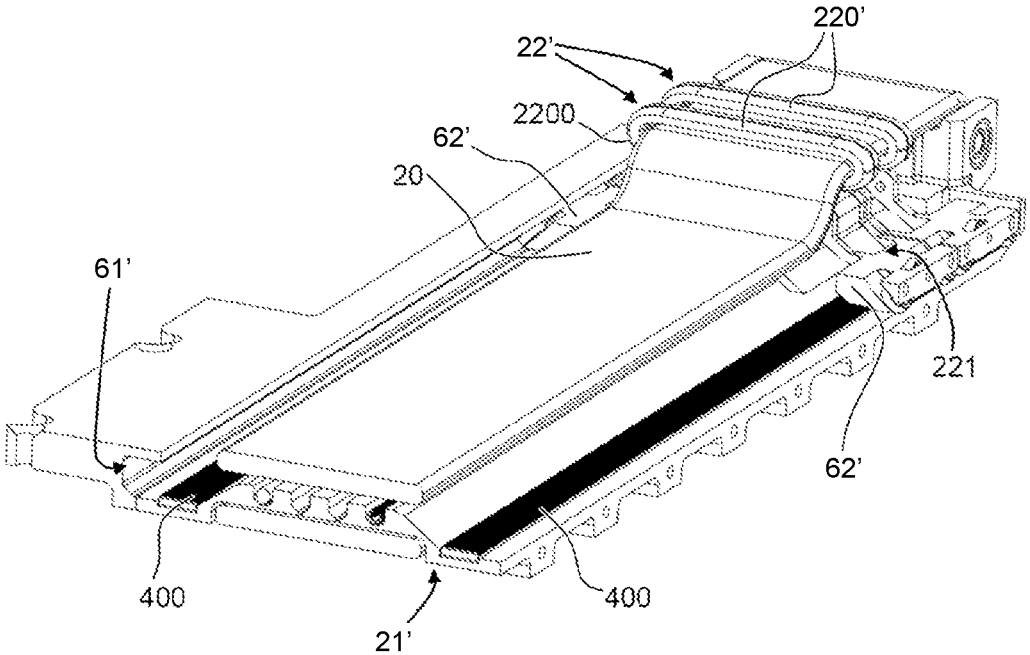
Figure 5A:
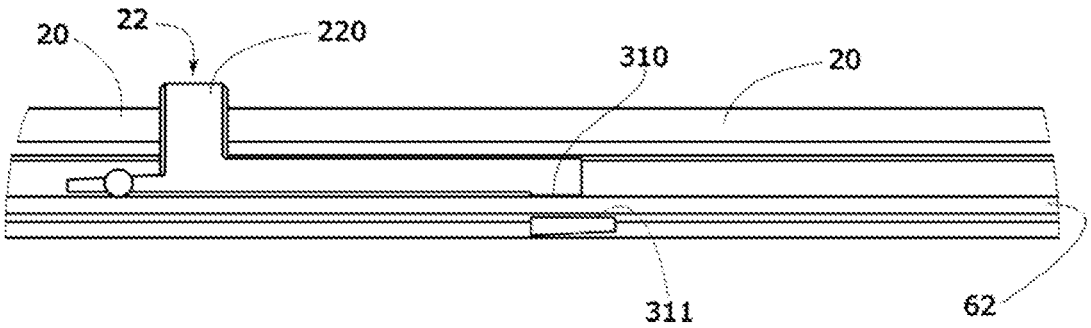
Figure 5B:
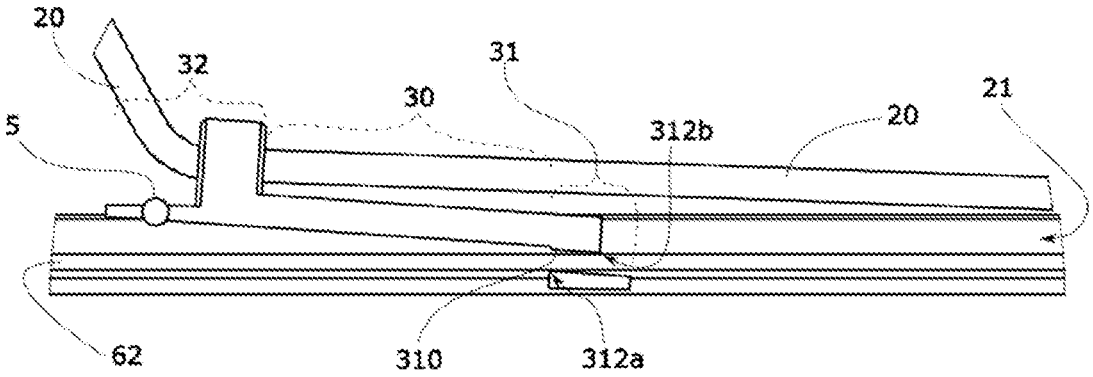
Figure 7:
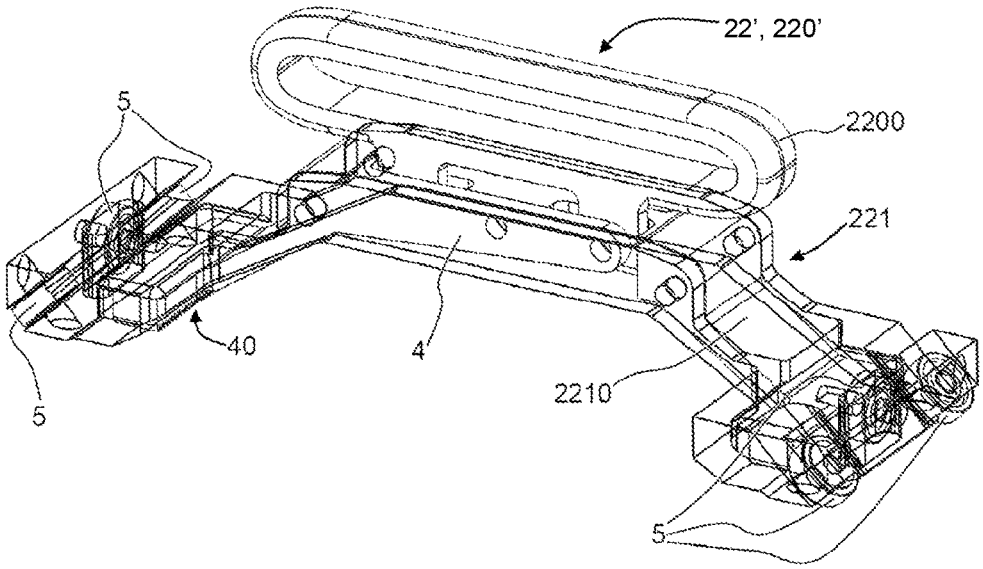
Figure 8A:
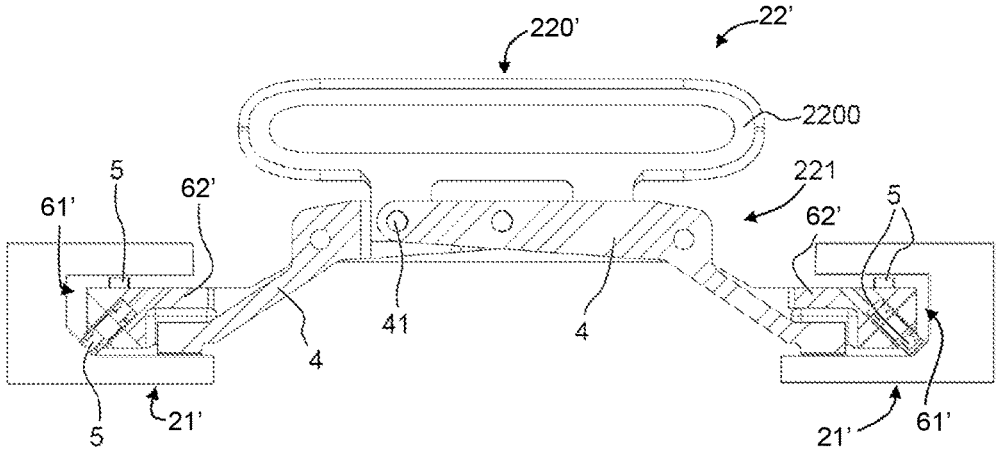
Figure 8B:
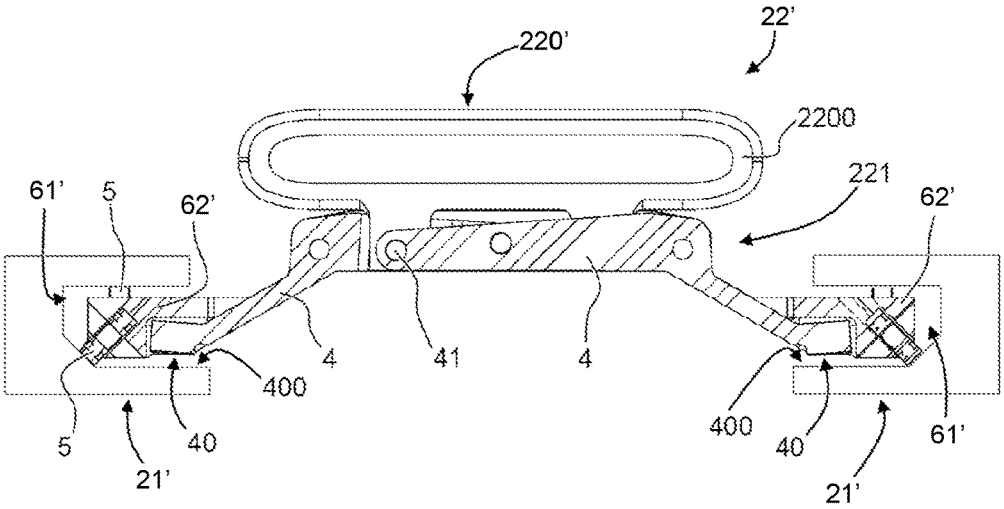

FIG. 5*a* is a sectional view of the first embodiment according to the section plane V-V of FIG. 4 in an unlocked position in which the tightening member is movable to slide along the rail;

FIG. 5*b* is a sectional view of the first embodiment according to the section plane V-V of FIG. 4 in a locked position in which the tightening member is immobilized on the rail;

FIG. 6 is a perspective view of a second preferred embodiment of the holding system of the piece of luggage according to the invention;

FIG. 7 is a perspective view of a tightening member of the second preferred embodiment drawn as a partially transparent line drawing to illustrate internal structural features;

FIG. 8*a* schematically illustrates the tightening member of the second embodiment in a locked position in which the tightening member is immobilized on the rail;

FIG. 8*b* schematically illustrates the tightening member of the second embodiment in an unlocked position in which the tightening member is movable to slide along the rail.

With reference to FIGS. 1, and 2*a* to 2*g*, the piece of luggage 1 according to the invention comprises a cavity 10 and a wall, called a support wall 100, against which an object O can be held in a storage position inside the piece of luggage 1.

The piece of luggage 1 is in particular a suitcase and more specifically an "briefcase".

The support wall 100 is rigid and flat.

To hold an object O against the support wall 100, the piece of luggage 1 according to the invention comprises a holding system comprising at least one strap 20.

Figure 1:
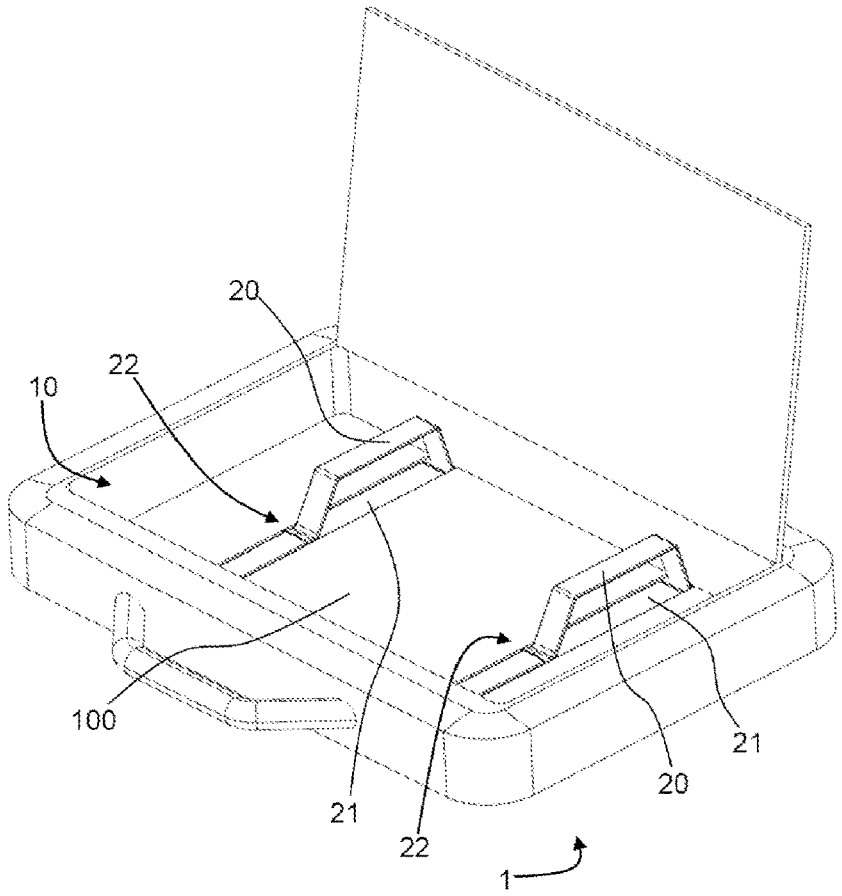

According to the present embodiment illustrated by FIG. 1, the holding system comprises two straps 20.

The straps 20 extend against the support wall 100 in the absence of stress. More specifically, the straps 20 extend from a first side of the support wall, to a second side of the support wall, opposite the first side.

Figure 2A:
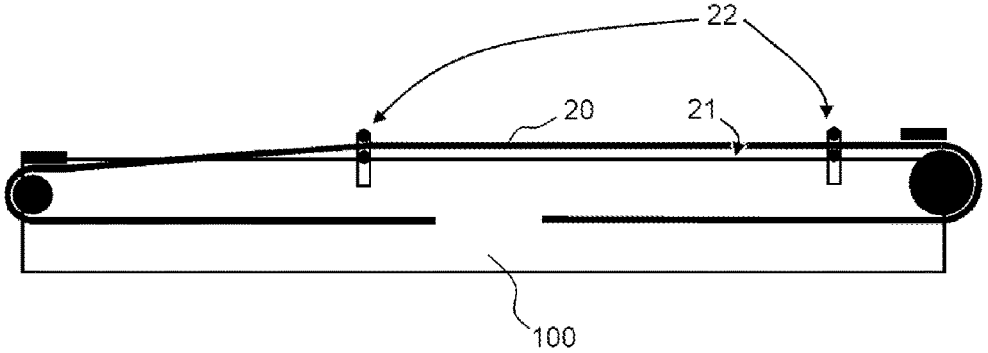

As illustrated in FIG. 2*a*, when the straps 20 are not used to hold an object, they are then pressed against the support wall 100.

In other words, at rest the straps 20 assume a position pressed against the support wall 100.

To this end, the straps 20 may be at least partially elastic or the piece of luggage comprises a system for tensioning the straps.

For example, the straps 20 can be made from an elastic material or have elastic strips.

These elastic strips can be located at the ends of the straps 20, below the support wall 100 so that the straps 20, in their pressed position or in a position where they are fully extended, still have a visible strip made of a noble material, such as leather, which is inelastic or less elastic than the elastic strips.

According to another example, a system for tensioning the straps 20 can be in the shape of springs pulling the ends of the straps 20, or else the shape of rollers coupled to springs so that the rollers tend to return the straps in their position pressed against the support wall 100.

According to the principle of the invention and as illustrated by FIGS. 1, and 2*a* to 2*g*, the holding system also comprises:

at least one rail 21;

at least one tightening member 22 slidably mounted on the rail 21.

The rail 21 is carried by the support wall 100.

The holding system comprises in particular a rail 21 for each strap 20.

According to the present embodiment illustrated by FIG. 1, the holding system comprises two straps 20 and two rails 21.

Each strap 20 extends to cover a rail 21 in the absence of stresses.

In other words, the holding system comprises a rail 21 underlying each strap 20 coupled to the support wall 100.

The tightening member 22 is in turn slidably mounted on the rail 21 at least partially covering the strap 20.

With reference to FIG. 4, the support wall 100 has a recess 1000 inside which the rail 21 is housed.

As illustrated by FIG. 4, when it is not subjected to external stresses and it is thus pressed against the support wall 100, the strap 20 is then flush with the surface of the support wall 100 directly adjacent to the recess 1000. More specifically, it is an upper face of the strap 20 which is flush with the surface of the directly adjacent support wall 100.

The strap(s) 20 thus do not protrude from the support wall 100.

Still according to the principle of the invention, the tightening member 22 is movable between:

an unlocked state in which it can slide freely along the rail 21;

a locked state in which it is immobilized on the rail 21.

With reference to FIGS. 2*a* to 2*g*, for a strap 20, the holding system comprises two tightening members 22.

With reference to the embodiment illustrated in FIG. 6, the holding system comprises three tightening members 22 for the same strap 20.

According to the embodiments illustrated by FIGS. 3 to 8*b*, each tightening member 22 comprises a bar 220 which covers the strap 20.

This bar 220 has in particular a width sufficient to extend to cover, that is to say above, the width of the strap 20.

Each tightening member 22 also comprises a base 221 which carries the bar 220 and which slides on the rail 21.

In the unlocked state of the tightening member 22, the bar 220 is in a low position close to the rail 21.

In the locked state of the tightening member 22, the bar 220 is in an upper position away from the rail 21 relative to the low position.

The strap 20 can drive the bar 220 from its low position to its high position.

Consequently, when the strap 20 assumes a position in which it moves away from the support wall 100 from the rail 21, then it exerts a traction on the bar 220 so that the bar 200 rises from its low position to its high position.

In other words, the low position of the bar 220 corresponds to a non-pulled state, and the high position of the bar 220 corresponds to a pulled state.

According to this design, the switching of the bar 220 from its low position (non-pulled state) to its high position (pulled state) causes the tightening member 22 to switch from its unlocked state to its locked state, thus immobilizing the tightening member 22 along the rail 21.

Conversely, the switching of the bar 220 from its high position (pulled state) to its low position (non-pulled state) causes the tightening member 22 to switch from its locked state to its unlocked state, then releasing the tightening member 22 and allowing it to slide freely along the rail 21.

Consequently, as illustrated by FIGS. 2*a* to 2*g* and as explained precisely below, by placing an object O under the strap 20, against the support wall 100, and by bringing the tightening member 22 closer to the object O, then the strap 20 is stretched away from the rail 21 from the tightening member 22 (due to the presence of the object O), and exerts a traction on the bar 220 allowing it to be switched in its high position (pulled state) and held it in this position.

The bar 220 thus constitutes an actuator allowing to switch the tightening member 22 from its unlocked state to its locked state, and from its locked state to its unlocked state.

To switch the tightening member 22 from its locked state to its unlocked state while the strap tends to hold the bar 220 in its high position (pulled state), a user only needs to press the bar 220 to switch it to its low position. The pressure of the user on the bar 220 then counteracts the traction exerted by the strap.

After the pressure of the user and the switching of the bar 220 in its low position, the user can slide the bar 220 freely along the rail 21, of course by maintaining pressure on the bar 22, so as to loosen the strap 20 around the object O.

According to the embodiments illustrated by FIGS. 4 to 8*b*, the base 221 has at least one wheel 5.

The or each wheel 5 is essentially underlying the bar 220, or located in the immediate vicinity of the bar 220.

The or each wheel 5 is in contact with the rail in the low position (non-pulled state) of the bar 220, thus allowing to facilitate the sliding of the base 221 along the rail, in particular if a pressure is exerted on the bar 220 to hold it in its low position (non-pulled state).

Figure 3:
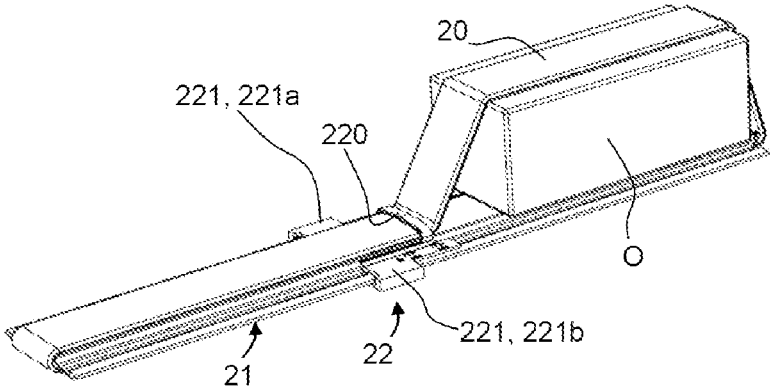
FIG. 3 is a schematic representation in a perspective view of a first preferred embodiment of the invention.

FIGS. 3 to 5 illustrate a first embodiment of the invention.

According to this first embodiment and with reference to FIG. 5, the base 221 extends longitudinally parallel to the rail 21 and has along its length:

- a first end portion 31 forming a sliding connection with the rail 21;
- a second end portion 32, opposite the first end portion 31, carrying the bar 220, and being at least partially movable in height relative to the rail 21;
- a central spacing portion 30 located between the first end portion 31 and the second end portion 32.

With reference to FIGS. 4 and 5, the first end portion 31 has two surfaces opposite to each other:

- a "ventral surface" 310;
- a "dorsal surface" 311.

The ventral surface 310 is in contact with a surface oriented towards the top of the rail 21, and the dorsal surface 311 is in contact with a surface oriented towards the bottom of the rail 21.

According to the present embodiment and with reference to FIGS. 3 and 4, the base 221 is split into two side portions 221*a*, 221*b* symmetrical to each other relative to a longitudinal plane L passing through a central axis of the rail 21, perpendicular to the support wall 100.

These two side portions 221*a*, 221*b* are located on either side of the bar 220.

The rail 21 has a support strip 210 for the strap 20. This support strip 210 is housed between the two side portions 221*a*, 221*b* of the base 221 of the tightening member 22.

According to this embodiment, each of the two side portions 221*a*, 221*b* has, at the first end portion 31, a groove 61.

These grooves 61 are symmetrical to each other relative to the longitudinal plane L.

In cooperation with these grooves 61, the rail 21 also has tabs 62 which are complementary to the grooves 61, each tab 62 entering inside one of the grooves 61. The tabs 62 each form a sliding connection with one of the grooves 61.

In this embodiment, the rail 21 thus has a support strip 210 and two tabs 62 extending on either side of the support strip 210.

Each of the tabs 62 of the rail 21 then has:

- an upwardly oriented surface on which the ventral surface 310 of the first end portion 31 of the base 221 comes into contact, and
- a downwardly oriented surface of the rail 21 on which the dorsal surface 311 of the first end portion 31 of the base 221 comes into contact.

With reference to FIG. 5, the dorsal surface 311 and the ventral surface 310 each have an edge 312*a*, 312*b* intended to be brought into the blocking position on the rail 21, and in particular on the tabs 62 of the rail 21, in the high position (pulled state) of the bar 220.

These edges 312*a*, 312*b* are longitudinally offset from each other along the base and more specifically along the first end portion 31. The edge 312*a* belonging to the dorsal surface 311 is located between the second end portion 32 and the edge 312*b* belonging to the ventral surface 310.

According to this embodiment and as illustrated in FIG. 3, if a user:

- positions an object O under the strap 20;
- brings the tightening member 22 close to the object O, and
- releases the pressure he exerts on the bar 220, then the strap 20 pulls the bar 220 in its high position (pulled state). With reference to FIG. 5, this traction braces the base 221 and causes a blocking of the edges 312*a*, 312*b* on the rail 21. The central spacing portion 30 creates a leverage effect which increases the pressure exerted by the edges on the rail 21, thereby increasing the blocking phenomenon.

FIGS. 6 to 8*b* illustrate a second embodiment of the invention.

With reference to these figures, the bar 220' is in the shape of a buckle 2200 through which the strap 20 is intended to be inserted.

As illustrated in FIGS. 7 and 8*b*, the tightening member 22 has friction surfaces 40.

According to the first variant embodiment illustrated by FIGS. 6, 7 and 8*b*, the friction surfaces 40 are notched and complementary to racks 400 belonging to the rail 21'.

In the high position (pulled state) of the bar 220', the friction surfaces 40 are remote from the rail 21', and in particular from the racks 400.

In contrast, in the low position (non-pulled state) of the bar 220', the friction surfaces 40 are applied against the rail 21', and in particular the notches of the friction surfaces 40 are anchored in the racks 400.

According to another variant embodiment not shown, the friction surfaces 40 can be made of a non-slip material.

With reference to FIGS. 6 to 8*b*, the base 221 of the tightening member 22 comprises:

- a carriage 2210 sliding on the rail 21';
- means for transmitting the movement of the bar 220' which is carried by the base 221, which comprises two levers 4 mounted to be movable in rotation on the carriage 2210.

The buckle 2200 is movable relative to the carriage 2210 using levers 4.

The levers 4 have the friction surfaces 40, and means for connection to the bar 220'. These connection means are in the shape of axis 41.

These levers 4 allow to move the friction surfaces 40 under the effect of the movement of the buckle 2200.

More specifically, the base 221, the levers 4 and the buckle 2200 together form a mechanism called a "butterfly mechanism" allowing the rotation of two opposite levers 4 during the vertical translation of the buckle 2200.

With reference to the embodiment illustrated by FIGS. 6, 8*a* and 8*b*, and as for the embodiment described previously illustrated by FIGS. 3 and 4, the rail 21' also has tabs 62' which are complementary to grooves 61'.

Unlike the previous embodiment described, the base 221 has two tabs 62' complementary to two grooves 61' belonging to the rail 21'.

As with the first embodiment, the grooves 61' are symmetrical to each other relative to a longitudinal plane L passing through a central axis of the rail 21' and perpendicular to the support wall 100.

The tabs 62' in particular belong to the carriage 2210.

As mentioned above, the base 221 has wheels 5.

With reference to FIGS. 6 and 7, the wheels 5 are carried by the tabs 62'. The wheels 5 are arranged so as to center the tabs 62' inside the grooves 61'.

According to this embodiment, when the user presses on the bar 220', the buckle 2200 is pressed on the carriage 2210. This recess results in the switching of the bar 220' from its high position (FIG. 8*a*) to its low position (FIG. 8*b*), or in other words from its pulled state to its non-pulled state.

This change in position of the bar 220' relative to the carriage 2210 is made possible thanks to the levers 40 which pivot about their axes 41 and which cause the switching of the friction surfaces 40 from their position applied against the rail 21' (FIG. 8*a*) to their position remote from the rail 21' (FIG. 8*b*). In other words, there is unspiking of the tightening member 22 from the racks 400 of the rail 21'.

Conversely, if the strap 20 pulls the bar 220', and thus the buckle 2200, in its high position (pulled state), then the friction surfaces 40 spike into the racks 400, thereby immobilizing the tightening member 22 in position along the rail 21.

With reference to FIGS. 2*a* to 2*g*, the operating principle of the holding system of a piece of luggage according to the invention is explained below.

In FIG. 2*a*, the strap 20 is pressed against the rail 21, on the support wall 100. The strap 20 then covers the rail 21. Two tightening members 22 are located along the rail 21.

Figure 2B:
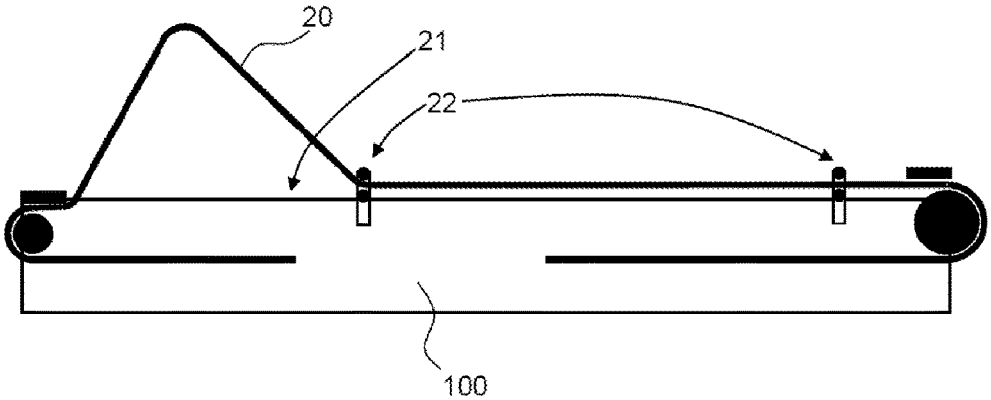

According to FIG. 2*b*, a portion of the strap 20 is lifted to slide a first object O between this portion of the strap 20 and the support wall 100.

Figure 2C:
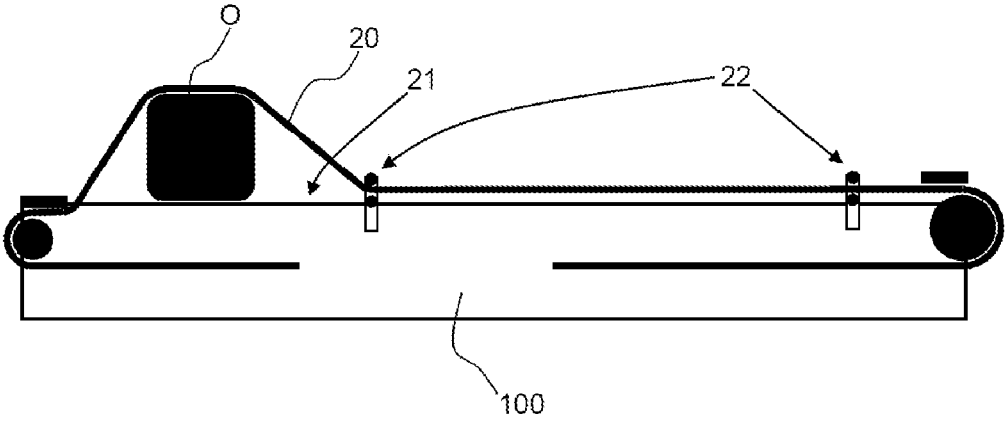

As shown in FIG. 2*c*, the first object O is pressed against the support wall 100 by the portion of the strap 20 previously lifted. This first object O is not, however, yet perfectly held by the strap holding system 20.

Figure 2D:
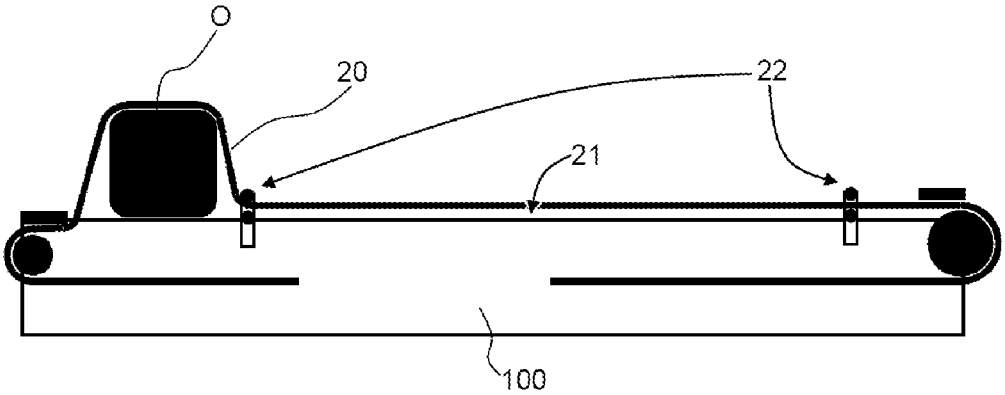

To this end and as illustrated by FIG. 2*d*, the tightening member 22 was slid in the direction of the object O. This tightening member 22 tightens the strap 20 around the object O by adapting the size of the strap 20 pressing the first object O on the support wall 100. The tightening member 22 also decreases the distance between the portions of the strap which extend from the support wall 100 to surround the first object O. Holding the first object O is thus optimized.

In order for the tightening member 22 to slide from the position illustrated in FIG. 2*d* to that illustrated in FIG. 2*d*, it must be in its unlocked state. As mentioned above, and according to the embodiments illustrated by FIGS. 3 to 8*b*, a user must press the bar 220, 220' to be able to switch the tightening member 22, 22' in its unlocked state and to be able to slide it.

Of course, the user must press the bar 220, 220' while sliding it to prevent it from returning to its locked state when it is being translated along the rail 21, 21'.

When the tightening member 22 is in its use position, as illustrated in FIG. 2*d*, the user then releases the bar 220 which returns to its upper position under the effect of the traction exerted by the strap 20. The tightening member 22 then switches into its locked state and is held in this state under the effect of the tension of the strap 20.

Figure 2E:
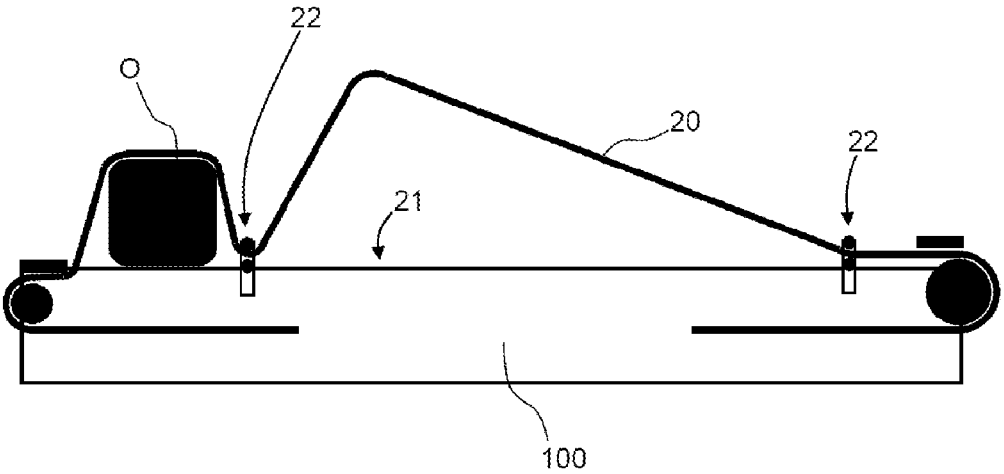
Figure 2F:
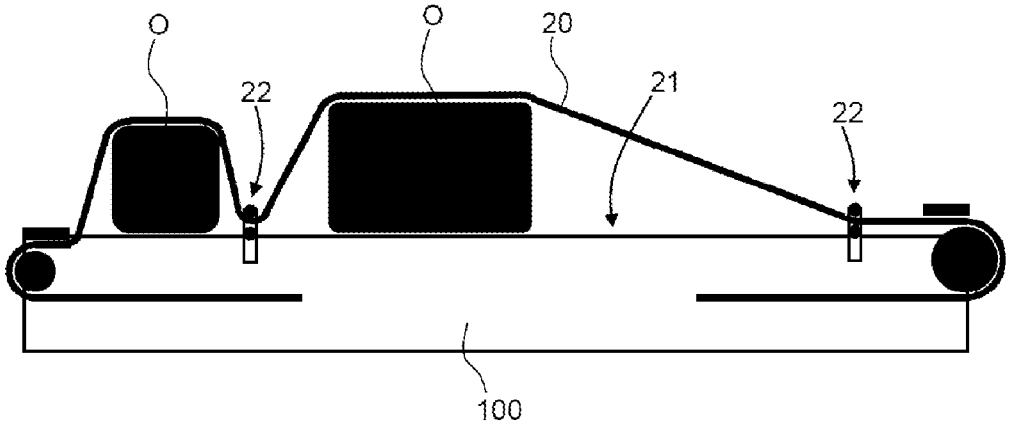
Figure 2G:
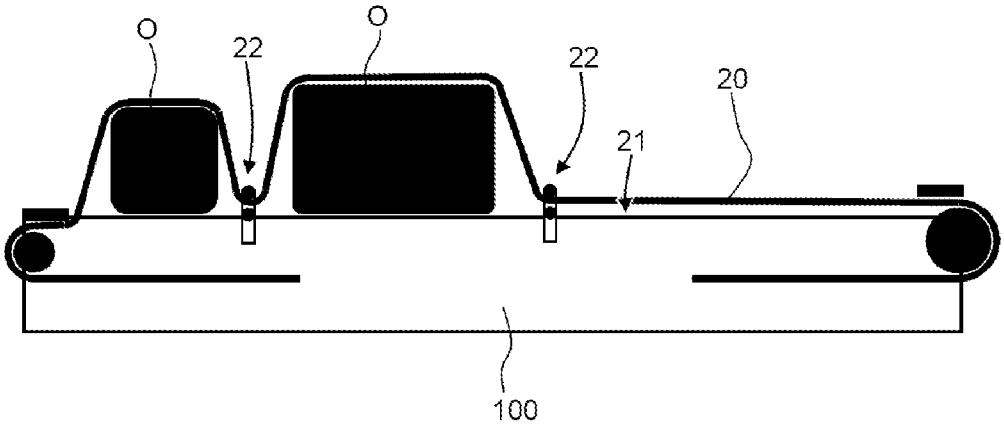

With reference to FIGS. 2*e* to 2*g*, the holding in position of a second object O is achieved in a similar manner to that of the first object O. Thus, a second portion of the strap 20 is spaced from the support wall 100, the second object O is introduced under the strap 20 which is then released. The last tightening member 22 (located on the right in the figures) is finally slid to the second object O to tighten the strap 20. The tension of the strap 20 also holds the bar 220 in its locked state, guaranteeing the correct holding of the second object O.

According to the principle of the invention, the same movement thus allows to adjust the size of the strap 20 according to the shape of an object to be held in the piece of luggage 1 and to lock the strap in position around the object O.

The first embodiment illustrated by FIGS. 3, 4 and 5 also has the advantage that any movement of an object O held inside the piece of luggage 1 increases the bracing of the base 221 and therefore the fixing of the tightening member 22.

The first embodiment also has the advantages of being particularly discreet, compact and light, while being easy to use.

The invention claimed is:

1. A piece of luggage comprising a holding system comprising at least one strap intended to hold an object in a storage position inside the piece of luggage by pressing the object against a wall of the piece of luggage called the support wall, at least one rail carried by the support wall, and at least one tightening member slidably mounted on the rail at least partially covering the strap, the strap being at least partially elastic or the piece of luggage comprising a system for tensioning the strap, wherein the strap has a position at rest in which it is not used to hold an object, the strap in its rest position being pressed against the rail, on the support wall, the strap then extending to cover the rail, and wherein the tightening member is movable between an unlocked state in which the tightening member slides freely along the rail and a locked state in which the tightening member is immobilized on the rail.

2. The piece of luggage according to claim 1, wherein the tightening member comprises a bar covering the strap, and a base carrying the bar and sliding on the rail, and wherein, in the unlocked state of the tightening member, the bar is in a low position close to the rail and, in the locked state of the tightening member, the bar is in a high position remote from the rail relative to the low position, the strap being capable of pulling the bar from its low position to its high position.

3. The piece of luggage according to claim 2, wherein the base extends longitudinally parallel to the rail and has along its length:

a first end portion having two surfaces opposite to each other, one called "ventral surface" being in contact with a surface oriented towards the top of the rail, and the other called "dorsal surface" being in contact with a surface oriented towards the bottom of the rail, each of the dorsal surface and of the ventral surface having an edge intended to be placed in the blocking position on the rail in the high position of the bar; and a second end portion, opposite the first end portion and carrying the bar, the second end portion being at least partially movable in height relative to the rail, and wherein the first end portion forms a sliding connection with the rail.

4. The piece of luggage according to claim 3, wherein the edges are longitudinally offset from each other along the base, the edge belonging to the dorsal surface being located longitudinally between the second end portion and the edge belonging to the ventral surface.

5. The piece of luggage according to claim 3, wherein the base has a central spacing portion located between the first end portion and the second end portion.

6. The piece of luggage according to claim 2, wherein the base is split into two side portions symmetrical to each other relative to a longitudinal plane passing through a central axis of the rail and perpendicular to the support wall, the two side portions being located on either side of the bar, and wherein the rail has a support strip for the strap which is housed between the two side portions of the base.

7. The piece of luggage according to claim 2, wherein the tightening member has at least one friction surface, and wherein:

in the high position of the bar, the friction surface is remote from the rail; and in the low position of the bar, the friction surface is applied against the rail.

8. The piece of luggage according to claim 7, wherein the base comprises:

a carriage sliding on the rail; and means for transmitting the movement of the bar, comprising at least one lever mounted movably in rotation on the carriage, the lever having:

the friction surface(s); and a means for connection to the bar, the bar being movable relative to the carriage so as to move the friction surface(s).

9. The piece of luggage according to claim 2, wherein the base has at least one wheel essentially underlying the bar, the wheel(s) being able to roll on the rail during sliding of the tightening member.

10. The piece of luggage according to claim 2, wherein:

one of the base or the rail has two grooves symmetrical to each other relative to a longitudinal plane passing through a central axis of the rail and perpendicular to the support wall; and the other of the base or the rail has two tabs each complementary to one of the grooves, the tabs forming slide connections with the grooves.

11. The piece of luggage according to claim 1, wherein for a strap, the holding system comprises at least two tightening members.

12. The piece of luggage according to claim 1, wherein the support wall has a recess housing the rail, the strap flush with the surface of the support wall directly adjacent to the recess in the absence of stresses.

* * * * *